United States Patent [19]

Madden

[11] 4,437,327

[45] Mar. 20, 1984

[54] METHOD AND APPARATUS FOR CIRCUMFERENTIALLY GROOVING THIN-WALLED CYLINDRICAL METAL OBJECTS

[75] Inventor: James A. Madden, Gainesville, Fla.

[73] Assignee: General Electric Company, Gainesville, Fla.

[21] Appl. No.: 337,199

[22] Filed: Jan. 5, 1982

[51] Int. Cl.[3] ..... B21D 17/04

[52] U.S. Cl. ..... 72/94; 72/105

[58] Field of Search ..... 72/84, 94, 105, 121, 72/106, 91, 92, 93

[56] References Cited

U.S. PATENT DOCUMENTS

| | | | |
|---|---|---|---|
| 1,792,812 | 2/1931 | Cameron | 72/94 |
| 2,567,334 | 9/1951 | Harrison et al. | 72/105 |
| 4,058,998 | 11/1977 | Franek et al. | 72/84 |
| 4,070,888 | 1/1978 | Gombas | 72/105 |
| 4,316,375 | 2/1982 | Lee, Jr. | 72/105 |

*Primary Examiner*—Lowell A. Larson

*Attorney, Agent, or Firm*—Henry J. Policinski

[57] ABSTRACT

An apparatus is disclosed for providing a circumferential groove in a thin-walled cylindrical metal object such as the can or container (A) for a battery cell. As each object moves along a path (51, 90) defined between guide rails (42, 44, 46, 48, 88) and star wheels (56, 58, 78), it is supported on a spring-biased plunger (102–112) positioned in a rotatable support table (96–100). In the preferred embodiment, a groove-forming mandrel (132–138) is gradually inserted into the object as it moves along the path so that a radially extending shoulder (134) of the mandrel engages the lip of the open end of the object before the object is contacted by a groove-forming wheel (158, 160) which is rotated adjacent the path. A tapered surface (138) on the grooving mandrel and a radially extending flange (160) on the grooving wheel cooperate to form a circumferentially extending groove in the wall of the object while the object rotates. Following formation of the groove, the mandrel is withdrawn from the object. A corresponding method of forming such a circumferential groove also is disclosed.

37 Claims, 7 Drawing Figures

FIG. 2
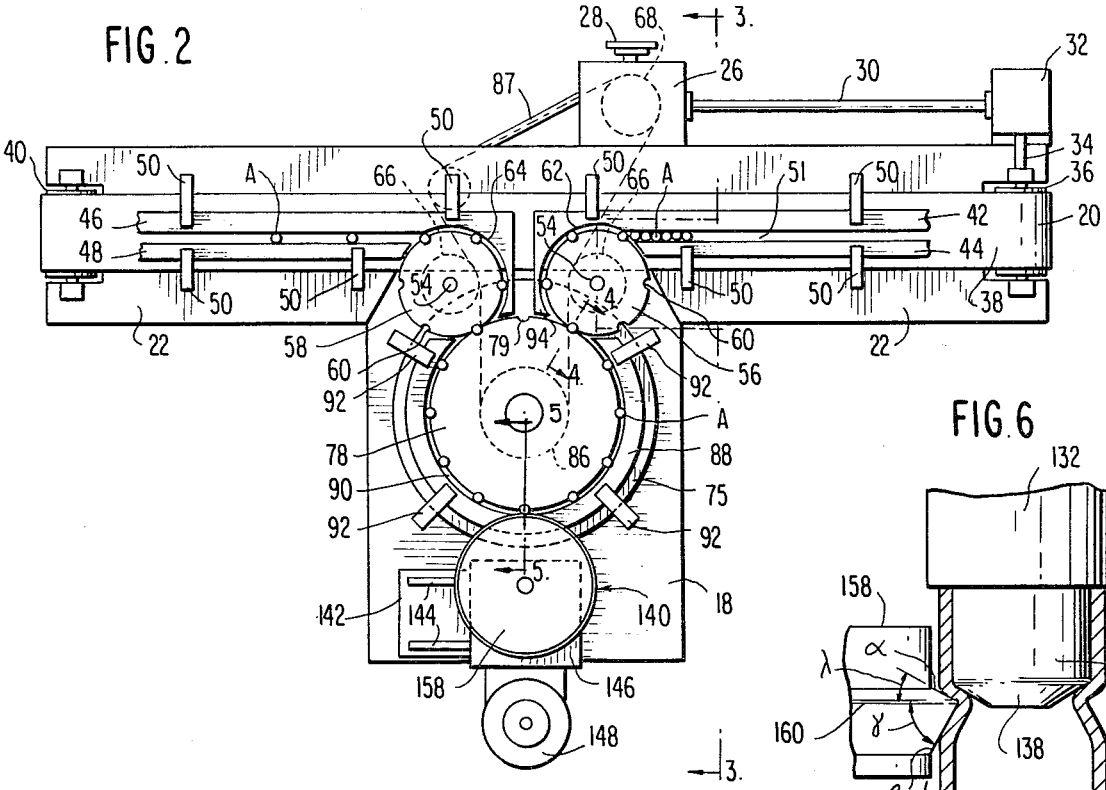
FIG. 6
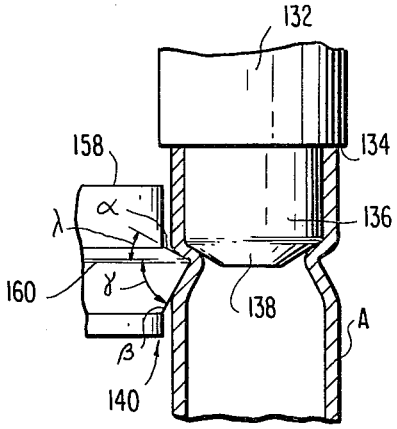
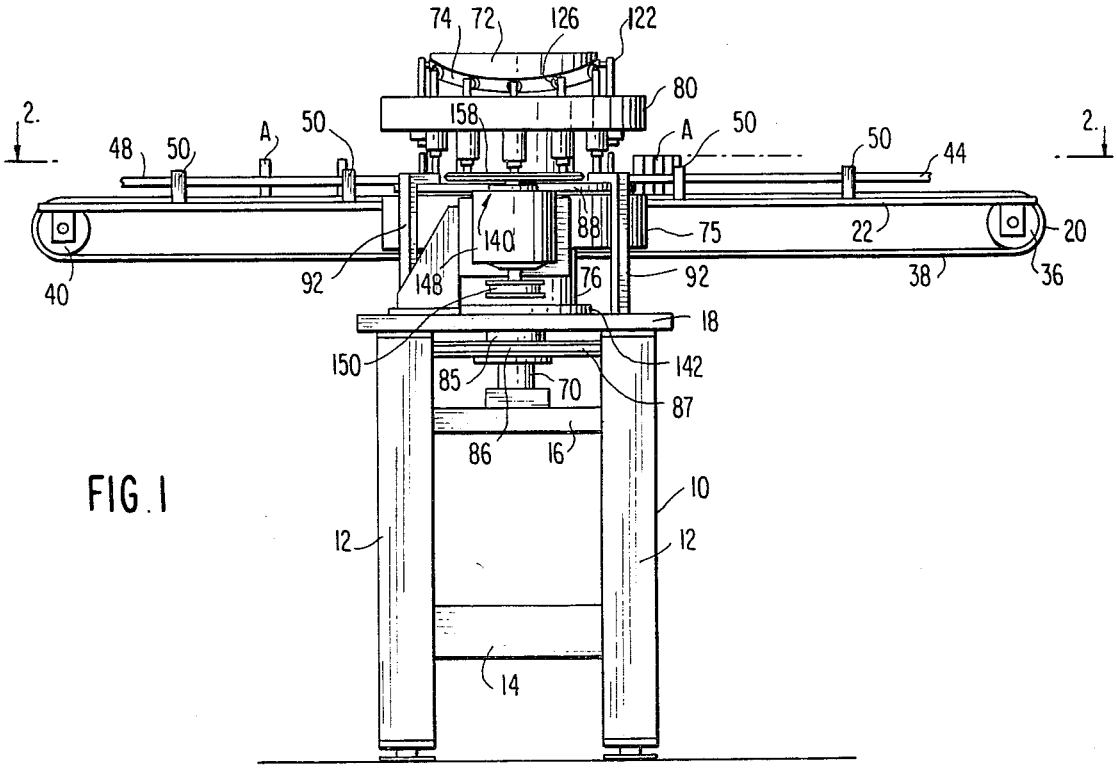
FIG. 1

METHOD AND APPARATUS FOR CIRCUMFERENTIALLY GROOVING THIN-WALLED CYLINDRICAL METAL OBJECTS

DESCRIPTION

Technical Field

The present invention concerns methods and apparatuses for cold forming of metal objects. More particularly, the invention concerns a method and apparatus for forming a circumferential groove in a thin-walled cylindrical metal object such as a can or container for a battery cell.

Background Art

Electro-chemical battery cells have been known for many years which include a thin-walled cylindrical metal container surrounding the electrical current-generating structure of the cell. Typically, such containers comprise a seamless metal tube or can open at least at one end. During assembly of the cell, the container wall is deformed as necessary to provide a flange which engages a closure structure to prevent leakage of electrolyte. To facilitate installation of such a closure, the wall of the container often has been provided with a radially inwardly projecting, circumferentially extending groove, the interior surface of which engages the closure structure. In the prior art, this circumferential groove has been formed by simultaneously engaging the outer circumference of a stationary container with a plurality of radially inwardly movable die elements which deform the wall of the container as desired. While this technique has been in use for many years, it is relatively slow, commonly producing only 20 to 30 grooved containers per minute. Moreover, the grooves produced by the radially moving die elements tend to be somewhat irregular in configuration, particularly at the points where the die elements mate to form the groove. Such irregularities can lead to difficulties in achieving an adequate seal with the cell closure. Thus, a need has existed for some time for a method and apparatus, both for more rapidly providing such circumferential grooves and for eliminating irregularities in the completed grooves.

Disclosure of the Invention

The primary object of the present invention is to provide a method and apparatus for circumferentially grooving a thin-walled, cylindrical metal object such as a battery container.

A further object of the invention is to provide such a method and apparatus which produce circumferential grooves at a substantially higher rate than has been achievable in the past and which produce grooves of improved geometric regularity.

Yet another object of the invention is to provide such a method and apparatus which will automatically provide circumferential grooves in a continuous or intermittent sequence of such objects.

These objects of the invention are given only by way of example. Thus, other desirable objectives and advantages inherently achieved by the disclosed method and apparatus may occur or become apparent to those skilled in the art. Nonetheless, the scope of the invention is to be limited only by the appended claims.

In the method according to the invention, a plurality of thin-walled cylindrical objects each having an axis and an open end are moved along a path. A forming mandrel having a circumferentially extending tapered portion is inserted into each object as it moves along the path and the object is engaged with a forming element having a radially extending grooving flange so that the flange and the tapered portion cooperate to form a circumferential groove. During groove formation, the object is permitted to rotate and following formation of the circumferential groove, the mandrel is removed from the object. Preferably, the mandrel also rotates as the groove is formed. The forming element preferably comprises a rotatable wheel from which the grooving flange projects radially outwardly, the wheel being rotated during formation of the circumferential groove.

An apparatus according to the present invention is especially suited for circumferentially grooving a thin-walled cylindrical object having an axis and an open end. A source of such objects, such as a conveyor, delivers them to a means for removing the objects from the source and delivering them along a path in a spaced relation to each other. As the objects are moved on the path, they are supported in such a manner that rotation of each object about its axis is permitted as it moves along the path. Means are provided for engaging each object to form a radially inwardly extending, circumferential groove in its wall as the object rotates while moving along the path. Finally, means are provided for removing each object from the path following formation of its circumferential groove.

The means for engaging each object preferably comprises at least one forming mandrel and means for inserting the mandrel along the axis through the open end of each object. Means are positioned to contact the exterior of each object as it moves along the path for causing the object to rotate and for progressively deforming the wall of the object in cooperation with the mandrel to form the circumferential groove. Each object or container has a lip around its open end and the forming mandrel preferably comprises a shoulder for engaging this lip. The means for supporting and permitting rotation of each object preferably comprises at least one support table on which the object rests as it moves along the path and means included in the support table for biasing the object into contact with the shoulder on the mandrel after the mandrel has been inserted. A bearing rotatably supports the table and the biasing means. In the preferred embodiment, a rotatable nest wheel is provided for moving the support table, the biasing means and the bearing means along the desired path. The biasing means comprises a plunger having an upper surface on which the object rests, a stop for limiting upward movement of the plunger toward the forming mandrel and a spring for biasing the plunger toward this stop. Thus, movement of the mandrel causes engagement of its shoulder with the lip of the object so that the plunger moves to compress the biasing spring. Preferably, the mandrel is mounted for rotation after its shoulder has engaged the lip of the object.

Insertion of the forming mandrel is achieved by means of a cam positioned near the path, such as a barrel cam when a rotary apparatus is used. A cam follower is operatively connected to each forming mandrel in position to engage the cam. Means are provided for moving each mandrel relative to the cam to cause the mandrel to be inserted into the open end of each object as the object moves along the path. In one embodiment of the invention, the forming mandrel comprises means for resiliently engaging the lip of the object as the object rests on the previously mentioned support table. An annular contact element surrounds the mandrel in position to engage the lip of the object as the mandrel is inserted and spring means are provided for biasing the contact element toward the lip, whereby movement of the mandrel causes engagement of the contact element with the lip so that the contact element moves to compress the spring. In this embodiment, the support table need not include a means for biasing the object toward the mandrel; however, both the mandrel and the support table preferably are mounted for rotation.

In the preferred embodiment of the invention, the source of cylindrical objects preferably comprises an infeed belt conveyor having a pair of spaced guide rails positioned thereabove so that the objects can move on the conveyor between the rails. The means for removing and delivering objects preferably comprises a first rotatable star wheel which engages each object as it moves between the guide rails and removes the objects one at a time from between the rails. A second rotatable star wheel is provided for engaging each object and removing it from the first star wheel. A further guide rail is spaced from the second star wheel for guiding each object along the desired path. After the circumferential groove has been formed in each object in the manner previously described, the objects are removed from the path by another rotatable star wheel which engages each object and transfers it from the path to an outfeed belt conveyor having a pair of spaced guide rails positioned thereabove so that the grooved objects move on the conveyor between the guide rails. The outfeed conveyor may be an extension of the infeed conveyor.

BRIEF DESCRIPTION OF THE DRAWINGS

FIG. 1 shows an elevation view of an apparatus according to the invention.

FIG. 2 shows a plan view, partially in section, taken along line 2—2 of FIG. 1.

FIG. 6 shows an enlarged, partially sectioned view of the forming mandrel and grooving wheel according to the invention, indicating their cooperation to produce a circumferential groove in an object A.

BEST MODE FOR CARRYING OUT THE INVENTION

Figure 3:
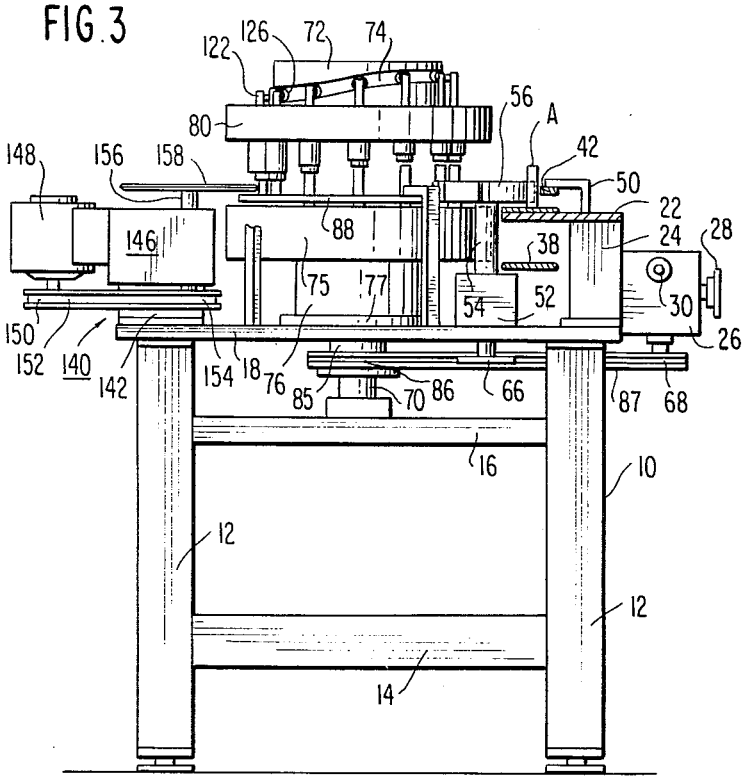
FIG. 3 shows a side elevation view, partially in section, taken along line 3—3 of FIG. 2.

The following is a detailed description of the preferred embodiments of the invention, reference being made to the drawings in which like reference numerals identify like elements of structure in each of the several Figures.

As shown in FIGS. 1–3, an apparatus according to the invention comprises a machine frame 10 having a plurality of support legs 12 arranged in a generally rectangular pattern. Horizontal stretcher members 14, a shaft support plate 16 and a table top plate 18 complete the rigid frame. An infeed and outfeed conveyor 20 is attached to the rear of frame 10 by means of an elongated conveyor belt support plate 22 supported by suitable upwardly extending legs 24, one of which shows in FIG. 3. A drive transmission 26 is supported by frame 10 and includes an input sprocket or pulley which, in use, is driven by a suitable chain or belt from a motor, not illustrated. A drive shaft 30 extends from one side of transmission 26 and is operatively connected by means for a right angle gear box 32 to the drive shaft 34 of a conveyor drive roller 36. A conveyor belt 38 extends around drive roller 36 at the infeed end of support plate 22 and around an idler roller 40 at the outfeed end of support plate 22.

A pair of parallel, preferably straight infeed guide rails 42, 44 and a similar pair of outfeed guide rails 46, 48 are positioned above conveyor belt 38 by a plurality of support arms 50 which extend upwardly from support plate 22. Infeed guide rails 42, 44 thus define a slot 51 therebetween through which a plurality of thin-walled, cylindrical metal objects, such a partially completed battery cells A, are delivered during operation of the apparatus. To minimize friction damage to the cells, the rails may be made from Nylon, Delrin or similar material. Although a belt conveyor is preferred, those skilled in the art will appreciate that other types of conveyors such as screw conveyors could also be used without departing from the scope of the present invention.

A pair of bearing blocks 52, only one of which is visible in FIG. 3, are supported by top plate 18. A drive shaft 54 extends upwardly from each bearing block 52 into engagement with an infeed star wheel 56 and an outfeed star wheel 58, as shown in FIG. 2. Each of star wheels 56, 58 comprises a plurality of circumferentially positioned, equally spaced pockets 60 sized to engage approximately half the circumference of each cell A. Plated steel or the like is preferred for the material of star wheels 56, 58. Both infeed star wheel 56 and outfeed star wheel 58 extend laterally above conveyor belt 38, as illustrated in FIGS. 2 and 3, so that their circumferences are essentially tangent to guide rails 42 and 46, respectively. Guide rail 42 includes a curved end portion 62 which partially surrounds the circumference of infeed star wheel 56; whereas, guide rail 44 terminates just adjacent infeed star wheel 56, as shown in FIG. 2. Thus, as star wheel 56 rotates, pockets 60 successively engage cells A moving through slot 51 and transfer them to the curved slot defined between end portion 62 and the circumference of star wheel 56. At the outfeed side of the apparatus, a curved end portion 64 is provided on guide rail 46 which partially surrounds the circumference of outfeed star wheel 58, as illustrated in FIG. 2. Guide rail 48 terminates just adjacent to outfeed star wheel 58. The function of outfeed star wheel 58 will be described subsequently. On the lower end of each shaft 54, a drive sprocket or pulley 66 is attached for operative engagement with a chain or belt driven by an output sprocket or pulley 68 provided on transmission 26.

Figure 5:
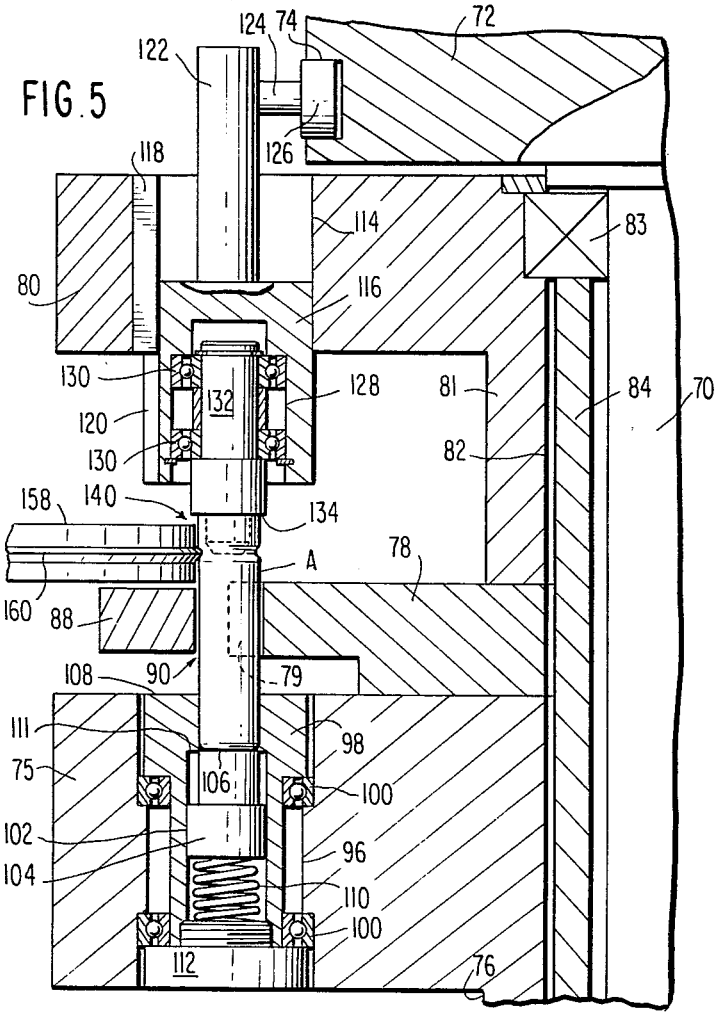
FIG. 5 shows a fragmentary sectional view taken along line 5—5 of FIG. 2.

FIGS. 1–5 illustrate that a fixed central support shaft 70 is mounted at one end thereof to extend upwardly from support plate 16. A stationary cylindrical barrel cam 72 is attached to the other, upper end of support shaft 70. A circumferentially extending, essentially sinusoidal cam slot 74 is provided in the side wall of cam 72. Slot 74 runs in a smooth, closed curve from a high point between infeed star wheel 56 and outfeed star wheel 58, to a low point at the diametrically opposite position. A nest wheel 75 having a central bore is positioned about shaft 70 and is supported by an integral, downwardly extending sleeve shaft 76. Near its lower end, sleeve shaft 76 engages a thrust bearing 77 supported by top plate 18, as shown in FIG. 3. The upper surface of nest wheel 75 supports a central star wheel 78 having a plurality of circumferentially located, equally spaced pockets 79 for engaging cells A to remove them from infeed star wheel 56, for conveying each cell through a grooving station and for delivering the grooved cells to outfeed star wheel 58, as will be described subsequently in greater detail. The upper surface of star wheel 78 supports a mandrel guide wheel 80 having a downwardly depending support skirt 81. The central bores of nest wheel 75, sleeve shaft 76, star wheel 78, guide wheel 80 and support skirt 81, in combination, define a central bore 82 within which a pair of spaced bearings 83 are retained, only the upper one of which is illustrated in FIG. 5. The other bearing preferably is positioned near the lower end of sleeve shaft 76 above thrust bearing 77, for example. A bearing spacer sleeve 84 is positioned between bearings 83 in the manner familiar to those skilled in the art. Finally, as shown in FIG. 3, the lower end of sleeve shaft 76 is provided with an extension 85 which protrudes beneath top plate 18 and supports a drive sprocket or pulley 86. A drive chain or belt 87 completes the drive train from output sprocket 68 over drive sprockets 66 and drive sprocket 86. As shown in FIGS. 2 and 5, a circular guide rail 88 extends from close proximity to infeed star wheel 56 around central star wheel 78 into close proximity with outfeed star wheel 58, thereby defining a circular slot 90 through which cells A are moved under the influence of star wheel 78. Preferably, star wheel 78 is made from plated steel and guide rail 88 is made from Nylon, Delrin or the like. Guide rail 88 is supported, for example, by a plurality of upwardly extending support arms 92 attached to top plate 18, as seen in FIGS. 1–3.

In operation, the infeed side of the apparatus thus far described functions in the following manner. Cells A are delivered on conveyor belt 38 so that they move through slot 51 defined between guide rails 42, 44. Belt 38 is run faster than star wheels 56, so that cells tend to accumulate as illustrated in FIG. 2 against the circumferential edge of the star wheel. Each time one of circumferential pockets 60 passes slot 51, a cell is pushed into the pocket so that it is moved from slot 51 into the curved slot defined between end portion 62 and the circumference of infeed star wheel 56. Movement continues in this curved slot until the cell passes the downstream end 94 of curved portion 62 at a point more or less tangent to central star wheel 78. See FIG. 4. At this point, one of the circumferentially spaced pockets 79 of star wheel 78 engages the cell and moves it from infeed star wheel 56 to the curved slot defined between circular guide rail 88 and the circumference of central star wheel 78.

As previously indicated, rotation of star wheel 78 occurs simultaneously with that of nest wheel 75. Nest wheel 75 includes a plurality of stepped bores 96 corresponding in number to circumferentially spaced pockets 79 on central star wheel 78. Each stepped bore 96 surrounds a cell support table 98 which is mounted for rotation in a pair of spaced bearings 100. Each support table 98 is provided with a stepped central bore 102 which slidably receives a stepped biasing plunger 104 having an upper surface 106 which is normally flush with the upper surface 108 of each support table 98. A spring 110 biases each plunger 104 upward into contact with a stop shoulder 111 provided in stepped bore 102. A spring and bearing retainer 112 is threaded into the bottom of bore 102 and is provided with radial clearance to bore 96 so that the assembly of elements 98–112 is free to rotate.

Positioned directly above each support table 98 and each circumferentially spaced pocket 79 is a through bore 114 at the outer edge of mandrel guide wheel 80. A piston 116 is slidably mounted in each bore 114 and is held against rotation by a key 118 affixed to the wall of bore 114, the key being positioned to mate with a keyway 120 provided in piston 116. On the upper side of each piston 116, an upwardly extending follower arm 122 is positioned to support a radially oriented axle 124 on which a cam roller 126 is rotatably mounted. Roller 126, in turn, is positioned to ride along in cam slot 74 when mandrel guide wheel 80 is rotated. A stepped bore 128 extends upwardly into piston 116 and houses a pair of bearings 130 which rotatably support a groove forming mandrel 132. This mandrel may be made from tool steel, for example, and is provided with a radially extending shoulder 134 below which protrudes a cylindrical boss 136 sized to fit through the open end of each cell A. The lower end of boss 136 is chamfered or tapered at 138 for a purpose subsequently to be described.

Figure 4:
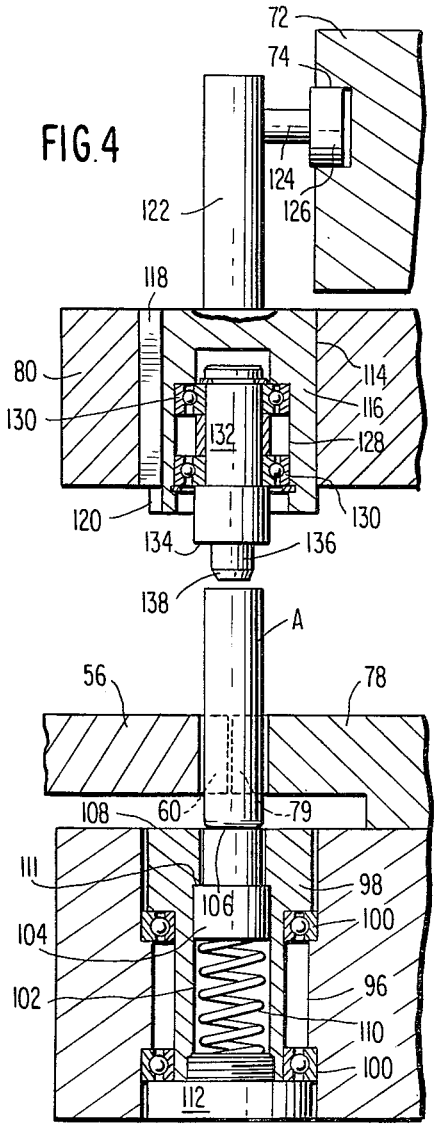
FIG. 4 shows a fragmentary sectional view taken along line 4—4 of FIG. 2.

Thus, as a cell A is moved from the position illustrated in FIG. 4 in which it is held in the circumferential pockets 60, 79 of star wheels 56, 78, the movement of cam roller 76 in cam slot 74 causes mandrel 132 to be moved downward so that it is gradually inserted into cell A. When the underside of radially extending shoulder 134 engages the lip surrounding the open end of cell A, force is transmitted to plunger 104, thus causing spring 110 to be compressed about one-half inch for example, and ensuring that contact is maintained between shoulder 134 and the lip of the cell during groove formation. Approximately 20 pounds spring force is adequate to maintain contact.

As nest wheel 75, star wheel 78 and guide wheel 80 continue to rotate, the apparatus eventually reaches a circumferential groove-forming station 140 as illustrated in FIGS. 1–3, 5 and 6. A bearing slide 142 is mounted on the upper surface of top plate 18 to permit movement toward and away from the center line of support shaft 70. A pair of brackets 144 extend upwardly from slide 142 to support a transmission 146 on the front side of which is mounted a variable speed DC motor 148. The drive shaft of motor 148 supports a drive sprocket or pulley 150 which engages a suitable chain or belt 152 which, in turn, drives an input sprocket or pulley 154 on transmission 146. The output shaft 156 of transmission 146 supports a rigid, circular grooving wheel 158 which may be made from tool steel and is provided with a radially outwardly extending grooving flange 160, as illustrated in FIGS. 5 and 6.

The geometry of tapered lower end 138 of forming mandrel 132 and the geometry of grooving flange 160 may be adjusted as desired to produce the desired circumferential groove configuration in cell A. Preferably, the geometry of flange 160 is configured to mate closely with the desired circumferential groove geometry to be formed in the object. In such a case, the spacing between the upper surface $\alpha$ of flange 160 and the tapered lower end 138 of mandrel 132 is equal to the thickness of the wall of the object; so that, the surfaces $\alpha$ and 138 are essentially parallel. The lower surface $\beta$ of flange 160 and the included angles $\gamma$ and $\lambda$ of the flange will, of course, vary with the desired groove geometry. The diameter of grooving wheel 158 and its rotational speed will control the rate at which the circumferential groove is formed between mandrel 132 and flange 160. For example, for a cell having an outside diameter of 0.450 inches and a wall thickness of 0.012 inches, the maximum diameter of flange 160 was approximately 8 inches, angle $\gamma$ was approximately 60° and angle $\lambda$ was approximately 15°. To provide approximately 10 revolutions of the cell from its first contact with the grooving wheel to completion of the circumferential groove, grooving wheel 158 was rotated at approximately 40 rpm and a nest wheel having a diameter of approximately 10 inches was rotated at about 8 rpm. As a result each cell A rotated at approximately 2400 rpm during formation of its circumferential groove. Excessively high grooving speeds can result in undesirable thinning and burnishing of the metal of the cell wall, as will be understood by those skilled in the metal forming arts.

Shortly before each cell A reaches the position illustrated in FIG. 5, the outside diameter of the cell will engage the peripheral edge of grooving flange 160. When this occurs, the cell begins to rotate relatively rapidly and as rotation of star wheel 78 continues, formation of the circumferential groove commences. During formation of the groove, the overall length of the cell decreases slightly as material is displaced radially inwardly. However, due to the biasing effect of plunger 104 and spring 110, the cell continues to be rotatably supported at both ends between surface 106 and shoulder 134 so that as it rotates, the cell does not tend to shift along or wobble about its long axis. If biasing plunger 102 and spring 104 were not provided, such shifting and wobbling, although slight, could result in undesirable irregularities in the completed circumferential groove. After the cell has moved past the position illustrated in FIG. 5, it continues to move along path 90 between star wheel 78 and circular guide rail 88 until it engages outfeed star wheel 58. The grooved cell is then removed from star wheel 78 and moved through the curved slot defined between the curved end portion 64 of guide rail 46 and outfeed star wheel 58. The cells then are deposited in the slot defined between straight guide rails 46, 48 through which they are moved by conveyor belt 38 until they reach a subsequent manufacturing station, not illustrated.

Although the use of a rotating grooving wheel is preferred, those skilled in the art will also appreciate that grooving wheel 158, 160 could be replaced by a stationary forming element comprised of merely a sector of grooving wheel 158 positioned as illustrated in FIG. 5. Or the grooving wheel may be held stationary for some operations. Depending upon the size of the cell and the malleability of its wall material, such an arrangement can provide an acceptable circumferential groove.

Figure 7:
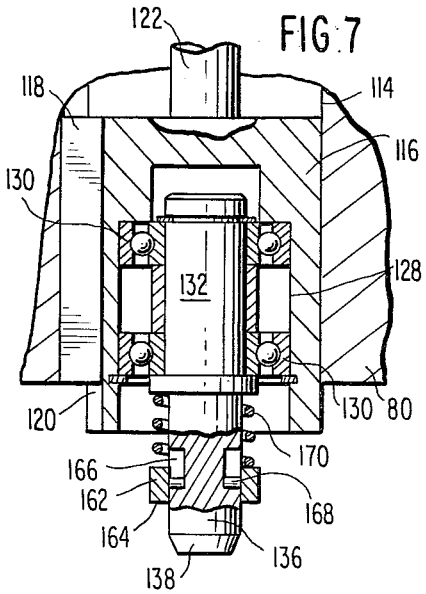
FIG. 7 shows a fragmentary sectional view of an alternative type of forming mandrel according to the invention.

FIG. 7 illustrates a modified embodiment of the invention in which the boss 136 of mandrel 132 has been lengthened to receive an annular contact element 162 having an essentially planar lower surface 164. Contact element 162 is slidably retained on boss 136 by means of at least a pair of axially extending keyways or slots 166 which receive correspondingly positioned keys or pins 168 extending radially inwardly from contact element 162. A spring 170 biases contact element 162 downward toward the lip around the open end of the cell A. When the mandrel illustrated in FIG. 7 is used, bore 102, plunger 104 and spring 110 may be omitted so that each cell A rests directly on the upper surface of support table 98. In this situation, contact element 162 engages the lip surrounding the open end of each cell A and maintains contact during formation of the circumferential groove.

Having described my invention in sufficient detail to enable those skilled in the art to make and use it, I claim:

1. An improved apparatus for progressively circumferentially grooving a thin-walled cylindrical object having a first axis and an open end, said apparatus comprising:

a source of said objects;

means for removing said objects from said source and delivering them along a circular path about a fixed second axis in spaced relation to each other, the rate of movement of said objects along said path being essentially constant;

means for supporting and for permitting rotation of each object about said first axis, as the object moves along said path;

rotating means rotating about a fixed third axis for engaging each object to progressively form a radially inwardly extending, circumferential groove in the wall thereof as the object rotates while moving along said path, said second fixed axis spaced apart from said third fixed axis, said object rotating about its first axis more than one revolution while in engagement with said rotating means thereby permitting said progressive forming; and means for removing each object from said path following formation of said circumferential groove.

2. Apparatus according to claim 1, wherein said means for engaging comprises at least one forming mandrel; means for inserting said forming mandrel along said axis through the open end of each object; and means positioned to contact the exterior of each object as the object moves along said path, for causing the object to rotate and for progressively deforming said wall in cooperation with said mandrel to form said circumferential groove.

3. Apparatus according to claim 2, wherein each object has a lip around its open end and said forming mandrel comprises a shoulder for engaging the lip; and said means for supporting and permitting rotation comprises at least one support table on which the object rests as it moves along said path; means in said support table for biasing each object into contact with said shoulder following insertion of said mandrel; bearing means for rotatably supporting said table and said means for biasing; and means for moving said table, said means for biasing and said bearing means along said path.

4. Apparatus according to claim 3, wherein said means for biasing each object comprises a plunger having an upper surface on which the object rests, stop means for limiting movement of said plunger toward said forming mandrel, and spring means for biasing said plunger toward said stop means, whereby movement of said mandrel causes engagement of said shoulder with the lip of the object so that said plunger moves to compress said spring means.

5. Apparatus according to claim 4, wherein said forming mandrel is mounted for rotation.

6. Apparatus according to claim 3, wherein said forming mandrel is mounted for rotation.

7. Apparatus according to claim 2, wherein said means for inserting comprises a cam positioned near said path; a cam follower operatively connected to said at least one forming mandrel for engaging said cam; and means for moving said mandrel relative to said cam to cause said mandrel to be inserted into the open end as each object moves along said path.

8. Apparatus according to claim 7, wherein each object has a lip around its open end and said forming mandrel comprises means for resiliently engaging the lip; and said means for supporting and permitting rotation comprises at least one support table on which the object rests as it moves along said path; bearing means for rotatably supporting said table; and means for moving said table and said bearing means along said path.

9. Apparatus according to claim 8, wherein said forming mandrel is mounted for rotation.

10. Apparatus according to claim 7, wherein each object has a lip around its open end and said forming mandrel comprises a shoulder for engaging the lip; and said means for supporting and permitting rotation comprises at least one support table on which the object rests as it moves along said path; means in said support table for biasing each object into contact with said shoulder following insertion of said mandrel; bearing means for rotatably supporting said table and said means for biasing; and means for moving said table, said means for biasing and said bearing means along said path in synchronism with insertion of said mandrel.

11. Apparatus according to claim 10, wherein said forming mandrel is mounted for rotation.

12. Apparatus according to claim 7, wherein said forming mandrel is mounted for rotation.

13. Apparatus according to claim 7, wherein said path is a closed loop and said cam is a barrel cam.

14. Apparatus according to claims 7, 8, 9, 12 or 13 wherein said means for removing and delivering comprises a rotatable star wheel for engaging each object and a guide rail spaced from said star wheel for guiding each object along said path; and said means for supporting and permitting rotation comprises at least one support table on which the object rests as it moves along said path, bearing means for rotatably supporting said table; and nest wheel means for moving said table and said bearing means along said path, said nest wheel means being operatively associated with said rotatable star wheel for rotation therewith; and means adapted to move in synchronism with said nest wheel for supporting said at least one forming mandrel, whereby movement of said nest wheel causes said follower to move on said cam so that said mandrel is inserted into the open end.

15. Apparatus according to claim 2, wherein each object has a lip around its open end and said forming mandrel comprises means for resiliently engaging the lip; and said means for supporting and permitting rotation comprises at least one support table on which the object rests as it moves along said path; bearing means for rotatably supporting said table; and means for moving said table and said bearing means along said path.

16. Apparatus according to claim 15, wherein said forming mandrel is mounted for rotation.

17. Apparatus according to claim 15, wherein said means for resiliently engaging comprises an annular contact element surrounding said mandrel in position to engage the lip as said mandrel is inserted, and spring means for biasing said contact element toward the lip, whereby movement of said mandrel causes engagement of said contact element with the lip so that said contact element moves to compress said spring means.

18. Apparatus according to claim 17, wherein said forming mandrel is mounted for rotation.

19. Apparatus according to claim 2, wherein said forming mandrel is mounted for rotation.

20. Apparatus according to claim 2, wherein said source comprises a belt conveyor and a pair of spaced guide rails positioned above said conveyor so that said objects can move on said conveyor between said rails; and said means for removing and delivering comprises a first rotatable star wheel for engaging each object and removing it from between said rails, a second rotatable star wheel for engaging each object and removing it from said first star wheel and a further guide rail spaced from said second star wheel for guiding each object along said path.

21. Apparatus according to claim 20, wherein said means for supporting and permitting rotation comprises at least one support table on which the object rests as it moves along said path, bearing means for rotatably supporting said table, and nest wheel means for moving said table and said bearing means along said path, said nest wheel means being operatively associated with said second rotatable star wheel for rotation therewith.

22. Apparatus according to claim 21, wherein said means for inserting comprises a cam positioned near said path, means adapted to move in synchronism with said nest wheel for supporting said at least one forming mandrel; and at least one cam follower operatively connected to said at least one forming mandrel for engaging said cam, whereby movement of said nest wheel causes said follower to move on said cam so that said mandrel is inserted into the open end.

23. Apparatus according to claim 21, wherein each object has a lip around its open end and said forming mandrel comprises a shoulder for engaging the lip, and said support table comprises means for biasing each object into contact with said shoulder following insertion of said mandrel.

24. Apparatus according to claim 23, wherein said forming mandrel is mounted for rotation.

25. Apparatus according to claim 20, wherein said means for inserting comprises a cam positioned near said path; a cam follower operatively connected to said at least one forming mandrel for engaging said cam; and means for moving said mandrel relative to said cam to cause said mandrel to be inserted into the open end as each object moves along said path.

26. Apparatus according to claim 25, wherein each object has a lip around its open end and said forming mandrel comprises a shoulder for engaging the lip; and said means for supporting and permitting rotation comprises at least one support table on which the object rests as it moves along said path; means in said support table for biasing each object into contact with said shoulder following insertion of said mandrel; bearing means for rotatably supporting said table and said means for biasing; and means for moving said table, said means for biasing and said bearing means along said path in synchronism with insertion of said mandrel.

27. Apparatus according to claim 24, wherein said forming mandrel is mounted for rotation.

28. Apparatus according to claim 25, wherein each object has a lip around its open and said forming mandrel comprises means for resiliently engaging the lip; and said means for supporting and permitting rotation comprises at least one support table on which the object rests as it moves along said path; bearing means for rotatably supporting said table; and means for moving said table and said bearing means along said path.

29. Apparatus according to claim 28, wherein said forming mandrel is mounted for rotation.

30. Apparatus according to claim 2, wherein said means positioned to contact each object comprises a rotatable wheel having a radially outwardly extending grooving flange and said mandrel comprises a circumferentially extending tapered portion which cooperates with said grooving flange to form said circumferential groove.

31. Apparatus according to claim 30, wherein said forming mandrel is mounted for rotation.

32. Apparatus according to claim 1, wherein said source comprises a belt conveyor and a pair of spaced guide rails positioned above said conveyor so that said objects can move on said conveyor between said rails; and said means for removing and delivering comprises a first rotatable star wheel for engaging each object and removing it from said first star wheel and a further guide rail spaced from said second star wheel for guiding each object along said path.

33. Apparatus according to claim 1, wherein said means for supporting and permitting rotation comprises at least one support table on which the object rests as it moves along said path; bearing means for rotatably supporting said table; and means for moving said table and said bearing means along said path.

34. Apparatus according to claim 1, wherein said means for removing each object from said path comprises a rotatable star wheel for engaging each object and removing it from said path following formation of said circumferential groove, a belt conveyor and a pair of spaced guide rails positioned above said conveyor so that said objects are transferred from said star wheel to move on said conveyor between said guide rails.

35. A method of progressively forming a circumferential groove of a substantially uniform depth in a thin-walled cylindrical object having a first axis and an open end, said method comprising the steps of:

moving each object along a circular path about a fixed second axis at an essentially constant rate of movement;

providing a forming mandrel having a circumferentially extending tapered portion;

inserting said mandrel into each object as each object moves along said path;

providing a forming element having a radially extending grooving flange, said forming element rotatable about a fixed third axis spaced apart from said second axis;

engaging each object with said forming element so that said flange and said tapered portion cooperate to progressively form said circumferential groove;

allowing each object to rotate as said circumferential groove is formed, said object rotating about its first axis more than one revolution while in engagement with said rotating forming element thereby permitting said progressive forming; and removing said mandrel from each object.

36. A method according to claim 35, further comprising the step of allowing said mandrel to rotate as said circumferential groove is formed.

37. A method according to claim 35, wherein said forming element is a rotatable wheel and said grooving flange projects radially outwardly from said wheel, further comprising the step of rotating said wheel during formation of said circumferential groove.

* * * * *